US005907914A

United States Patent [19]

Theurer

[11] Patent Number: 5,907,914

[45] Date of Patent: Jun. 1, 1999

[54] TRACK MAINTENANCE MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 08/889,978

[22] Filed: Jul. 10, 1997

[30] Foreign Application Priority Data

Aug. 14, 1996 [AT] Austria ..... 1469/96

[51] Int. Cl.[6] ..... E01B 27/17; E02F 5/22

[52] U.S. Cl. ..... 37/105; 104/2; 171/16; 37/104

[58] Field of Search ..... 37/104, 105; 104/2; 171/16

[56] References Cited

U.S. PATENT DOCUMENTS

| | | | |
|---|---|---|---|
| 4,108,076 | 8/1978 | Knape | 104/2 |
| 4,357,874 | 11/1982 | Theurer . | |
| 4,502,389 | 3/1985 | Theurer et al. . | |
| 5,125,345 | 6/1992 | Theurer et al. | 37/104 X |
| 5,257,580 | 11/1993 | Theurer et al. . | |
| 5,553,674 | 9/1996 | Theurer et al. . | |
| 5,611,403 | 3/1997 | Theurer et al. | 171/16 |

*Primary Examiner*—Heather Shackelford
*Attorney, Agent, or Firm*—Collard & Roe, P.C.

[57] ABSTRACT

A track maintenance machine for excavating material from a track bed comprises a machine frame comprising an upwardly recessed machine frame section, undercarriages supporting the machine frame on the track for movement in an operating direction, and sequentially arranged on the machine frame in the operating direction, a ballast receptacle comprising chutes for discharging the ballast from the receptacle, an inclined, vertically adjustable and revolvable endless excavating chain comprising a drive at an upper end for revolving the chain, the excavating chain being mounted underneath the upwardly recessed machine frame section for excavating the material from the bed, a track lifting device, a conveying arrangement arranged to remove the received excavated material and having an inlet end arranged below the upper excavating chain end to receive the excavated material therefrom, the ballast discharging chutes being arranged immediately behind the conveying arrangement inlet end in the operating direction, and a ballast clearing device mounted underneath the upwardly recessed machine frame section and comprising ballast clearing tools and drives for adjusting the ballast clearing tools vertically and transversely to the longitudinal direction. The track lifting device is arranged between the excavating chain and the ballast clearing device.

7 Claims, 1 Drawing Sheet

TRACK MAINTENANCE MACHINE

BACKGROUND OF THE INVENTION

1. Field of the Invention present invention relates to a track maintenance machine for excavating material from a bed supporting a track including rails, which comprises a machine frame extending in a longitudinal direction and comprising an upwardly recessed machine frame section, undercarriages supporting the machine frame on the track for movement in an operating direction, and sequentially arranged on the machine frame in the operating direction, a ballast receptacle comprising means for discharging the ballast from the receptacle, an inclined, vertically adjustable and revolvable endless excavating chain having an upper end and comprising a drive at the upper end for revolving the chain, a track lifting device, and a conveying arrangement arranged to remove the received excavated material and having an inlet end arranged below the upper excavating chain end to receive the excavated material therefrom.

2. Description of the Prior Art

U.S. Pat. No. 5,553,674 discloses a ballast cleaning machine comprising a vertically adjustable endless excavating chain revolvable around the machine frame and delivering the excavated ballast to a screening arrangement for cleaning. A ballast storage car may be connected to the rear end of the ballast cleaning machine so that additional clean ballast stored in the car may be used for preparing a new ballast bed. A vertically and transversely adjustable suction pipe is arranged ahead of the excavating chain, in the operating direction, to aspirate ballast ahead of the excavating chain. In this way, a gap is created in the ballast bed to enable the transverse excavating chain strand to be inserted underneath the track.

Another track maintenance machine has been disclosed in U.S. Pat. No. 5,257,580. It serves for the excavation of material from a track bed, in conjunction with producing a protective layer on the subgrade of a track. To enable a large volume of ballast to be excavated, the revolvable excavating chain is of large dimension and its upper portion is revolved around the machine frame, for which reason the machine frame must have a section of correspondingly reduced transverse dimensions to permit the excavating chain to be revolved therearound. This increases the cost of production of the machine frame. A ballast storage receptacle is mounted on the rear end of the machine frame to enable additional ballast to be continuously delivered to the operating site while the encrusted ballast is excavated and a conveying arrangement removes the excavated ballast to a storage car preceding the machine in the operating direction. An undercarriage with four axles precedes the excavating chain in the operating direction and is displaceable in the longitudinal direction of the machine frame to enable the track to be lifted sufficiently to enable the large excavating chain to be operated without difficulty.

Finally, it is known from U.S. Pat. Nos. 4,357,874 and 4,502,389 to use a ballast excavating chain mounted underneath an upwardly recessed machine frame section in conjunction with the removal of track sections from the track. The machine frame must be longer than the track sections to be removed and the wheel base must be correspondingly wide.

SUMMARY OF THE INVENTION

It is the primary object of this invention to provide a track maintenance machine of the first-described type and which is particularly useful for rapid and efficient operation in relatively short track sections.

The above and other objects are accomplished by the invention in a track maintenance machine for excavating material from a bed supporting a track including rails, which comprises a machine frame extending in a longitudinal direction and comprising an upwardly recessed machine frame section, and undercarriages supporting the machine frame on the track for movement in an operating direction, by sequentially arranging on the machine frame in the operating direction: a ballast receptacle comprising means for discharging the ballast from the receptacle, an inclined, vertically adjustable and revolvable endless excavating chain having an upper end and comprising a drive at the upper end for revolving the chain, the excavating chain being mounted underneath the upwardly recessed machine frame section for excavating the material from the bed, a track lifting device, a conveying arrangement arranged to remove the received excavated material and having an inlet end arranged below the upper excavating chain end to receive the excavated material therefrom, the ballast discharging means being chutes arranged immediately behind the conveying arrangement inlet end in the operating direction, and a ballast clearing device mounted underneath the upwardly recessed machine frame section and comprising ballast clearing means and drive means for adjusting the ballast clearing means vertically and transversely to the longitudinal direction. The track lifting device is arranged between the excavating chain and the ballast clearing device.

Such a track maintenance machine can be produced at minimum cost and can be operated in connection with the track clearing device during short down-times of train traffic. The reduced production cost is due primarily to the simplified shape of the machine frame, which does away with the expensive reduction of the transverse dimension of the machine frame section around which the excavating chain is trained. Since the revolvable endless excavating chain is mounted underneath the upwardly recessed machine frame section, the excavating chain length is correspondingly reduced, which shortens the conveying path of the excavated ballast to the inlet end of the conveying arrangement removing the excavated ballast. At the same time, the ballast clearing device preceding the excavating chain provides a means for quickly and simply producing a transverse channel in the track bed to enable the excavating chain to be threaded into the track bed underneath the track. In addition, since the endless excavating chain and the ballast clearing device are arranged underneath the upwardly recessed machine frame section, they are within excellent view of a suitably arranged operator's cab.

BRIEF DESCRIPTION OF THE DRAWING

The above and other objects, advantages and features of the present invention will become more apparent from the detailed description of a now preferred embodiment thereof, taken in conjunction with the accompanying drawing wherein.

DETAILED DESCRIPTION OF THE PREFERRED EMBODIMENT

Figure 1:
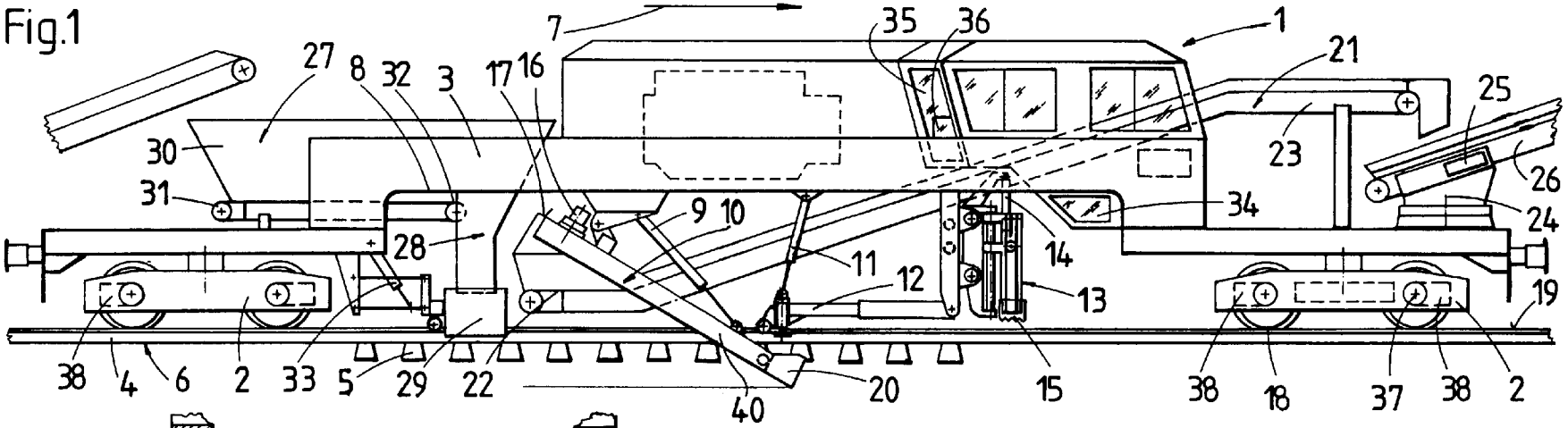
FIG. 1 is a side elevation view of a track maintenance machine with an excavating chain and a ballast clearing device preceding the same in the operating direction.

The somewhat schematic drawing shows track maintenance machine 1 for excavating material from a bed supporting track 6 including rails 4 fastened to ties 5. The machine comprises machine frame 3 extending in a longitudinal direction and comprising upwardly recessed machine frame section 8, and undercarriages 2 supporting machine frame 3 on track 6 for movement in an operating direction, indicated by arrow 7.

Sequentially arranged on the machine frame in the operating direction are:

Ballast receptacle 27 comprising means 28 for discharging the ballast from the receptacle; inclined, vertically adjustable and revolvable endless excavating chain 10 having an upper end and comprising drive 16 at the upper end for revolving the chain, drives 9 linking the excavating chain to the machine frame for vertically adjusting the excavating chain and the excavating chain being mounted underneath upwardly recessed machine frame section 8 for excavating the material from the bed; vertically adjustable track lifting device 12, drives 11 linking the track lifting device to the machine frame for vertically adjusting the track lifting device; conveying arrangement 21 arranged to remove the received excavated material and having inlet end 22 arranged below the upper excavating chain end to receive the excavated material therefrom, ballast discharging means 28 being chutes 29 arranged immediately behind conveying arrangement inlet end 22 in the operating direction; and ballast clearing device 13 mounted underneath upwardly recessed machine frame section 8 and comprising ballast clearing means 15 and drives 14 for adjusting the ballast clearing means vertically and transversely to the longitudinal direction. Track lifting device 12 is arranged between excavating chain 10 and ballast clearing device 13.

The undercarriages have wheels contacting track rails 4 at points 18 defining reference plane 19 and inclined endless excavating chain 10 has an upper end point 17 vertically spaced no more than two meters from the reference plane in an operating position of the excavating chain. This provides a short conveying path for the excavated material from lower, transversely extending strand 20 of the revolving excavating chain to the highest point 17 of the excavating chain whence the excavated material is discharged.

Conveying arrangement inlet end 22 is vertically spaced no more than one meter from reference plane 19. Conveying arrangement 21 comprises a first conveyor band extending upwardly from inlet end 22 to conveyor band section 23 above ballast clearing device 13, and second conveyor band 26 mounted on a front end of machine frame 3, in the operating direction, and being rotatable about vertical axis 24 and displaceable by drive 25 in the longitudinal direction.

Ballast receptacle 27 comprises ballast storage bin 30 mounted on a rear end of machine frame 3, in the operating direction, and having a bottom constituted by conveyor band 31 having discharge end 32, and discharging means 28 comprises vertically adjustable chutes 29 arranged to receive the ballast from discharge end 32 of bottom conveyor band 31. Discharge chutes 29 are spaced from each other in a direction extending perpendicularly to the longitudinal direction above ties 5 and are arranged immediately behind conveying arrangement inlet end 22 in the operating direction.

The track maintenance machine 1 further comprises operator's cab 34 arranged underneath recessed machine frame section 8 immediately ahead of ballast clearing device 13 in the operating direction, and a further operator's cab 35 arranged above ballast clearing device 13. Cabs 34, 35 have control panels 36 enabling an operator to operate the movable operating devices of the machine.

Undercarriages 2 are swivel trucks comprising two axles 37 and a separate drive 38 for each axle. Storage cars may be coupled to machine 1 at the front and rear ends for respectively receiving the excavated material from conveyor band 25 and for supplying fresh ballast to ballast storage bin 30.

Figure 2:
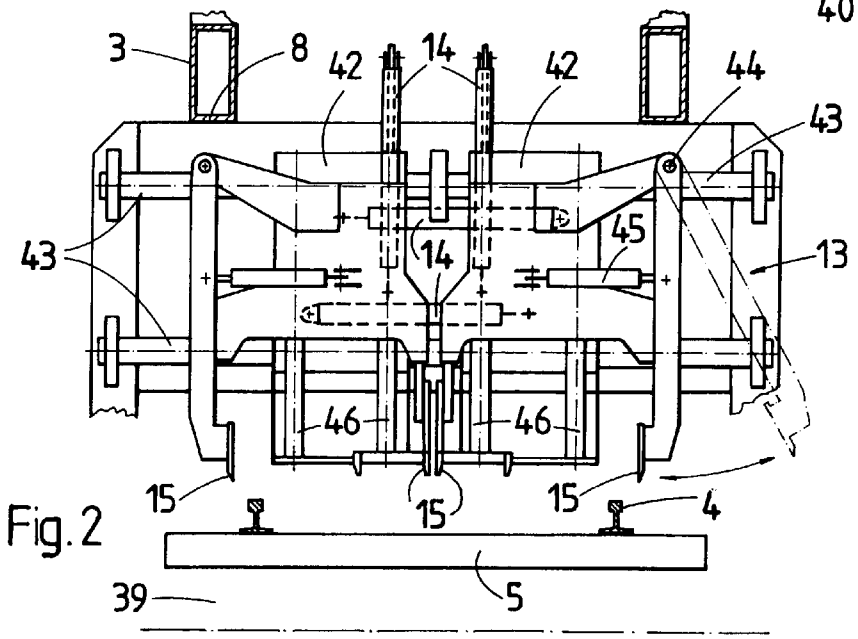
FIG. 2 is an enlarged end view showing the ballast clearing device.

A specific embodiment of ballast clearing device 13 is illustrated in FIG. 2. This ballast clearing device comprises two pairs of ballast clearing elements 15, 15, each pair being arranged for operation in one half of the track. Each pair of ballast clearing elements is mounted on a carrier frame 42 which is transversely displaceably supported on guide columns 43 extending horizontally and perpendicularly to the longitudinal direction. Each distal ballast clearing element 15 remote from the center of track 6 is pivotally mounted on carrier frame 42 for pivoting about axis 44 extending in the longitudinal direction between a position shown in full lines and a position shown in phantom lines. This enables the ballast to be removed to the track bed shoulder laterally outside the track. Drives 14 enables each carrier frame 42 to be vertically adjusted along vertical guide columns 46.

Figure 3:
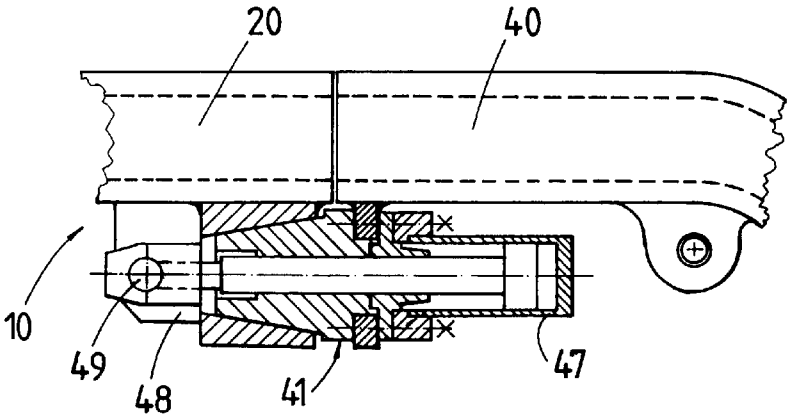
FIG. 3 is an enlarged fragmentary view showing a detail of the excavating chain, partly in section.

When ballast clearing device 13 is lowered into the track bed and carrier frames 42 are transversely displaced, ballast clearing elements 15 will remove the ballast towards the track shoulders to form gap 39 in the track bed (schematically indicated in phantom lines). Transverse excavating chain strand 20 can then be inserted in this transverse gap in the track bed underneath track 6. Machine 1 is then driven forwardly until both inclined longitudinal strands 40 of excavating chain 10 are in a position to be connected to transverse excavating chain strand 20 by a rapid connector 41 (shown in FIG. 3).

The illustrated rapid connector 41 is comprised of hydraulic cylinder 47 affixed to each longitudinal strand 40 of the excavating chain, and flange 48 affixed to transverse strand 20 of the excavating chain, which may be connected to a piston rod of the hydraulic cylinder by bolt 49.

What is claimed is:

1. A track maintenance machine for excavating material from a bed supporting a track including rails, which comprises (a) a machine frame extending in a longitudinal direction and comprising
  (1) an upwardly recessed machine frame section, (b) undercarriages supporting the machine frame on the track for movement in an operating direction, and sequentially arranged on the machine frame in the operating direction, (c) a ballast receptacle comprising
  (1) a ballast storage bin mounted on a rear end of the machine frame, in the operating direction, and
  (2) means for discharging the ballast from the ballast storage bin, (d) an inclined, vertically adjustable and revolvable endless excavating chain having an upper end and comprising
  (1) a drive at the upper end for revolving the chain,
  (2) the endless excavating chain being mounted underneath the upwardly recessed machine frame section for excavating the material from the bed, (e) a track lifting device, (f) a conveying arrangement arranged to remove the received excavated material and
  (1) having an inlet end arranged below the upper excavating chain end to receive the excavated material therefrom, (2) the ballast discharging means being chutes arranged immediately behind the conveying arrangement inlet end in the operating direction, and (g) a ballast clearing device mounted underneath the upwardly recessed machine frame section and comprising (1) ballast clearing means and (2) drive means for adjusting the ballast clearing means vertically and transversely to the longitudinal direction, (3) the track lifting device being arranged between the excavating chain and the ballast clearing device.

2. The track maintenance machine of claim 1, wherein the undercarriages have wheels contacting the track rails at points defining a reference plane and the inclined endless excavating chain has an upper end point vertically spaced no more than two meters from the reference plane in an operating position of the excavating chain.

3. The track maintenance machine of claim 1, further comprising an operator's cab arranged underneath the recessed machine frame section immediately ahead of the ballast clearing device in the operating direction.

4. The track maintenance machine of claim 3, comprising a further operator's cab arranged above the ballast clearing device.

5. The track maintenance machine of claim 1, wherein the undercarriages are swivel trucks comprising two axles and a separate drive for each axle.

6. The track maintenance machine of claim 1, wherein the ballast receptacle comprises a ballast storage bin having a bottom constituted by a conveyor band having a discharge end, and the discharging means comprises vertically adjustable chutes arranged to receive the ballast from the discharge end of the bottom conveyor band.

7. The track maintenance machine of claim 1, wherein the conveying arrangement comprises a first conveyor band extending upwardly from the inlet end to a conveyor band section above the ballast clearing device, and a second conveyor band mounted on a front end of the machine frame, in the operating direction, and being rotatable about a vertical axis and displaceable by a drive in the longitudinal direction.

* * * * *